US007056057B2

(12) United States Patent
Marchant

(10) Patent No.: US 7,056,057 B2
(45) Date of Patent: Jun. 6, 2006

(54) FLUID FLOWS CONTROL APPARATUS AND METHOD OF USE

(76) Inventor: Robert Beniah Marchant, 2900 Calle Heraldo, San Clemente, CA (US) 92673

( * ) Notice: Subject to any disclaimer, the term of this patent is extended or adjusted under 35 U.S.C. 154(b) by 0 days.

(21) Appl. No.: 10/652,381

(22) Filed: Aug. 29, 2003

(65) Prior Publication Data

US 2005/0047875 A1 Mar. 3, 2005

(51) Int. Cl.
*E02B 3/12* (2006.01)

(52) U.S. Cl. ..... 405/15

(58) Field of Classification Search ..... 405/15, 405/16, 17, 19, 21, 32, 107, 111, 115, 302.6, 405/302.7

See application file for complete search history.

(56) References Cited

U.S. PATENT DOCUMENTS

| | | | | |
|---|---|---|---|---|
| 3,780,861 | A | 12/1973 | Hirs | 210/80 |
| 4,418,432 | A | 12/1983 | Vidal | 4/286 |
| 4,650,368 | A * | 3/1987 | Bayer | 405/111 |
| 4,799,821 | A | 1/1989 | Brodersen | 405/115 |
| 4,947,791 | A * | 8/1990 | Laier et al. | 119/221 |
| 5,030,031 | A | 7/1991 | Brown | 405/26 |
| 5,419,659 | A * | 5/1995 | Mercer | 405/302.7 |
| 5,511,904 | A | 4/1996 | Van Egmond | 405/52 |
| 5,750,026 | A | 5/1998 | Gadkaree et al. | 210/502.1 |
| 5,830,281 | A | 11/1998 | Kliewer et al. | 134/6 |
| 6,368,017 | B1 | 4/2002 | Black | 405/15 |
| 6,422,787 | B1 | 7/2002 | Mikell | 405/15 |
| 6,547,493 | B1 * | 4/2003 | Spangler et al. | 405/302.6 |
| 2001/0007309 | A1 | 7/2001 | Malone et al. | 210/170 |
| 2002/0131826 | A1 | 9/2002 | Spangler et al. | 405/302.4 |
| 2002/0131827 | A1 | 9/2002 | Spangler et al. | 405/302.6 |
| 2002/0159845 | A1 | 10/2002 | Mikell | 405/302.6 |
| 2002/0168227 | A1 * | 11/2002 | Rubin, Jr. | 405/17 |
| 2002/0168234 | A1 | 11/2002 | Hlld | 405/302.4 |
| 2003/0031511 | A1 | 2/2003 | Tyler | 405/15 |

* cited by examiner

*Primary Examiner*—Sunil Singh
(74) *Attorney, Agent, or Firm*—Gene Scott & Patent; Law & Venture Group

(57) ABSTRACT

A fluid flows control apparatus includes an elongate stocking having a flexible cylindrical sidewall. The sidewall has plural apertures of a shape and placement in the sidewall as to cover a majority of the surface area and to enable the sidewall to expand radially in preference to axial extension. The stocking is filled with a filter media that may also be chemically or biologically reactive or expansive upon absorption of water.

15 Claims, 2 Drawing Sheets

FLUID FLOWS CONTROL APPARATUS AND METHOD OF USE

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to devices for controlling water runoff on lands subject to erosion, and more particularly to the conformation of a fill retaining stocking particularly suited for holding materials for diverting, pooling, absorbing and chemically or biologically changing water flows advantageously.

2. Description of Related Art

The following art defines the present state of this field:

Hirs, U.S. Pat. No. 3,780,861 describes a method for filtering contaminants from suspension in liquids by utilizing, as a filter medium, granulated shells of black walnut.

Vidal, U.S. Pat. No. 4,418,432 describes a new article of flexible and springy though rigid enough water impervious material provided with spikes or bristles or open web of crinkled filaments or rough indented openings to be installed around any conventional stopper for preventing hair, hairpins, or any other object carried away with the water flow during the taking of showers or washings or the like, from entering and clogging the drainpipes of bathtubs, lavatories and the like, through an entangling action carried out by said spikes or bristles or web or rough indented openings, and said article having a body which is shaped to be adapted to surround the lifted conventional pop-up stoppers or the like, of the drain control systems of bathtubs, lavatories and the like, and which may take any of several preferred cross section forms, such as for example, a hollow core elongated semicylindrical form which is integral with a flat imperforate lower portion or base, providing several preferred undersurfaces or a hollow core cylindrical form, or a vertical strip-like form, or a cup-like form, or a stepped strip-like form, and said forms being constituted by a net-like structure with a plurality of openings, which in the three last mentioned cross section forms, is integral with imperforate zones and with an outwardly directed surrounding flexible flat base having a central hole defined therein and the base providing several preferred undersurfaces.

Brodersen, U.S. Pat. No. 4,799,821 describes a dike structure for use in containment and/or controlling the flow of spilled hazardous liquids includes an elongated flexible tube formed of a chemically resistant plastic which is deployed as needed at the spill site and filled with water to form a base for the dike structure. A suitable joint packing material is used as needed to form a leak-proof seal between the water filled tube and the ground surface upon which it is deployed.

Brown, U.S. Pat. No. 5,030,031 describes a damming and barrier-forming device which includes a porous, biodegradable elongated fabric tube closable at one or both ends, and having a diameter of from four inches to two feet and a length of at least four feet. The elongated fabric tube, which can typically be constructed of burlap, is filled with earth after one end has been closed, and the earth-filled tube is then laid in a desired configuration adjacent or around a shrub or plant which is to be nourished and sustained by water impounded behind, or within, the damming and barrier-forming device. A method is described for using the damming and barrier-forming device.

Van Egmond, U.S. Pat. No. 5,511,904 describes a funnel structure for filtering and discharging storm sewage into an aquifer from a bottom of a manhole. The funnel is adapted to receive unitized filters. These filters can be selected from known materials to most effectively remove known types of contaminants from the storm sewage. The structure is designed to be employed both as a new installation, say within a park or a residential subdivision, to reduce leads on the storm sewage system and as an adaptation to existing manholes within a storm sewage collection system, thus augmenting the capacity of that system.

Gadkaree et al., U.S. Pat. No. 5,750,026 describes an incremental backup system including a storage unit, which is accessed in block units of a predetermined size, for storing data to be backed up. Difference map information stored in the storage unit records the latest backup generation number, indicating when data in each block has been updated. A latest update generation management mechanism manages backup generation numbers for each block. A difference management mechanism inputs and stores backup data in a backup unit. The backup data includes data in a block of the storage unit which is updated in a specified backup generation based on the difference map information, a position of the block in the storage unit, and a backup generation in which the block has been updated.

Kliewer et al., U.S. Pat. No. 5,830,281 describes a method for using a heretofore industrial waste material for the utilitarian purpose of controlling and containing a liquid on a hard surface. The method includes the steps of accumulating an industrial waste material in the form of paper dust in a bindery for use as a loose filler for a container, forming a container from a fabric having a porosity sufficient for passage of the liquid therethrough, substantially entirely filling the container with the paper dust as accumulated at the bindery, and thereafter closing the container after it has been substantially filled with the accumulated paper dust from the bindery. Additionally, the method includes placing the container on the surface after closing in order to control and contain the liquid on the hard surface thereby.

Black, U.S. Pat. No. 6,368,017 describes a detention filter system for the temporary accumulation and storage of storm water runoff for limiting the rate of runoff from a developed tract of land to no more than that which was naturally discharged from the same tract when in its prior undeveloped state. The system includes one or more conventional rip rap filled gabion boxes which may be aligned end-to-end along the edge of a developed parcel of real estate so that storm water can run off into the boxes and temporarily accumulate therein. The system also includes a sheet of porous fabric or perforated sheet, attached to and covering a surface of the gabion boxes to restrict the rate of flow of storm water runoff flowing through the boxes and the sheet to a downstream storm drain, storm sewer or stream. The sheet may be formed of two or more layers of the porous fabric or perforated sheet. The gabion boxes can function to stabilize an earth cut located on a lower edge of a developed tract such as a driveway and parking lot to keep the cut from eroding or can form a porous dam or barrier for a temporary storm water impoundment basin. When the boxes are used against an earth cut, sidewalks and other development can be built over the boxes to minimize the undeveloped area dedicated to the system.

Mikell, U.S. Pat. No. 6,422,787 describes a synthetic bale and method that are used to control water flow, soil erosion, and sediment flow at a construction site. The synthetic bale is made from a sheet member formed from ground carpet fibers that are packed together. The sheet member is rolled up to form a body member and the body member is received within a cover, the cover being made from a mesh material. One or both ends of the cover are tied. The body member is secured to the ground by passing at least one stake through the cover and the body member and into the ground.

Malone et al., U.S. 2001/0007309 describes filter elements for draining wastewater into the soil in leach fields comprising net sacks filled with scrap rubber or plastic chips and supplied with fabric filter cloth. Leach fields are constructed by excavating trenches, placing a first row of filter elements at the bottom of the trenches, installing a drain pipe on top of the row of filter elements, placing a second row of filter elements on top of the first row and the drain pipe, overlapping the pieces of filter cloth to provide a barrier to the surrounding soil, and backfilling the trench with soil.

Spangler et al., U.S. 2002/0131826 describes a modular erosion and sediment control barrier. The linear modular erosion and sediment control barrier is constructed of fiber logs joined end-to-end. Each fiber log is made of a quantity of loose fibers retained in a tubular casing by a plug. The tubular casing includes an extended section, which is peeled back and folds over the end of the coupler fiber log during storage and transportation. When deployed, the extended section is unfolded to receive the end of an adjacent fiber log. The two fiber logs are secured together by a cord and hooks.

Spangler et al., U.S. 2002/0131827 describes a linear modular erosion and sediment control barrier that is constructed of fiber logs joined end-to-end, the logs having a maximum length of about 8 feet long. Each fiber log is made of a quantity of loose fibers retained in a tubular casing by a plug. The tubular casing includes an extended section which is peeled back and folds over the end of the coupler fiber log during storage and transportation. When deployed, the extended section is unfolded to receive the end of an adjacent fiber log. The two fiber logs are secured together by a cord and hooks. The combination of a plurality of coupler fiber logs on the surface of a pallet is particularly suited for storing and transporting the logs. Transporting and storing the preferred embodiments of the novel combination requires less space, reduces the incidence of log rupture during storage and/or transportation, utilizes conventional equipment and provides for reduced storing, transportation and handling costs related to the installation of a erosion control barrier.

Mikell, U.S. 2002/0159845 describes a synthetic hay bale and method that are used to control water flow, soil erosion, and sediment flow at a construction site. The synthetic hay bale is made from a sheet member formed from ground carpet fibers that are packed together. The sheet member is rolled up to form a body member and the body member may be received within a mesh cover or may be strapped. A rod can be longitudinally inserted into the rolled up body member. The body member is secured to the ground by passing at least one stake through the body member or straddling the body member and inserting the stake into the ground.

Hild, U.S. 2002/0168234 describes an erosion control blanket comprising a layer of sand, a layer of polyethylene, a blanket layer, a soil-less mixture layer, and a seed mixture. The components are disposed in a blanket of a predetermined configuration, and rolled or folded. A method of making the blanket comprises the steps of constructing a frame, adding a layer of sand inside the frame, adding a layer of polyethylene over the sand layer, adding a blanket layer over the polyethylene, adding a layer of soil-less mixture over the blanket layer, adding a seed mixture to the soil-less mixture, aging the components, and harvesting the aged components. The step of aging preferably includes the steps of adding fertilizer, adding a water retention substance, and watering the components. Preferably, a poly film covers the frame. The step of harvesting preferably includes the steps of cutting the aged components into a predetermined configuration, and rolling or folding the cut components.

Tyler, U.S. 2003/0031511 describes exemplary devices, systems, and methods, embodiments of some of which can be useful for controlling erosion, retaining sediment, preventing siltation, treating runoff, removing pollutants, remediating environmental damage, protecting plants, establishing vegetation, protecting ecosystems, and/or restoring waterways and/or other riparian areas. At least one exemplary device includes a tubular mesh enclosure formed from a mesh material having a nominal opening size of less than 0.5 inches, a ratio of a length of the mesh enclosure to a diameter of the mesh enclosure greater than 40, having an opposing pair of ends, at least one of said ends sealed, said enclosure surrounding a filling. It is emphasized that this abstract is provided to comply with the rules requiring an abstract that will allow a searcher or other reader to quickly ascertain the subject matter of the technical disclosure. This abstract is submitted with the understanding that it will not be used to interpret or limit the scope or meaning of the claims.

Our prior art search with abstracts described above teaches devices, systems, and methods for controlling erosion, a granular filter medium, a drain filter having filamentary surface irregularities to entangle hair and debris, a method and apparatus for containment and or directing the flow of spilled hazardous liquids, a damming and barrier-forming device and method, a storm water infiltration device, a device for removal of contaminants from fluid streams, a method for controlling and containing a liquid on a hard surface, a storm water detention filter system, a synthetic bale and method of using the same for erosion control, a retrievable filter element for subsurface drainage, modular fiber log erosion and sediment control barriers, synthetic hay bale and method of using same, and an erosion control system and method, but does not teach the construction of a stocking particularly suited for holding materials for diverting water flows advantageously through the use of non-bilateral stretch resistance. The present invention fulfills these needs and provides further related advantages as described in the following summary.

SUMMARY OF THE INVENTION

The present invention teaches certain benefits in construction and use which give rise to the objectives described below.

The present invention is fluid flow control apparatus including an elongate stocking having a flexible cylindrical sidewall containing a filter media. The sidewall has plural apertures of a shape and placement in the sidewall as to cover a majority of its surface area and to enable the sidewall to expand radially in preference to axial extension. The filter media may be chemically reactive or hygroscopically expansive.

A primary objective of the present invention is to provide an apparatus and method of use of such apparatus that provides advantages not taught by the prior art.

Another objective is to provide such an invention capable of mechanically capturing particulate carried in fluid run-offs.

A further objective is to provide such an invention capable of unilateral stretching so as to contain a selected amount of the filler material by radial expansion without appreciable axial extension.

A still further objective is to provide such an invention capable of unilateral stretching in the radial direction without appreciable axial extension when a filler material expands due to fluid absorption.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

The present invention is fluid flow control apparatus used for filtering water runoff and diverting water runoff, as for example in both urban and rural locations. The apparatus comprises an elongate flexible stocking 10 containing a fill material 20 preferably of intricate shape providing a large outer surface area, and, or a highly hydroscopic material capable of expanding to several times size when engorged with water or other fluid.

Figure 1:
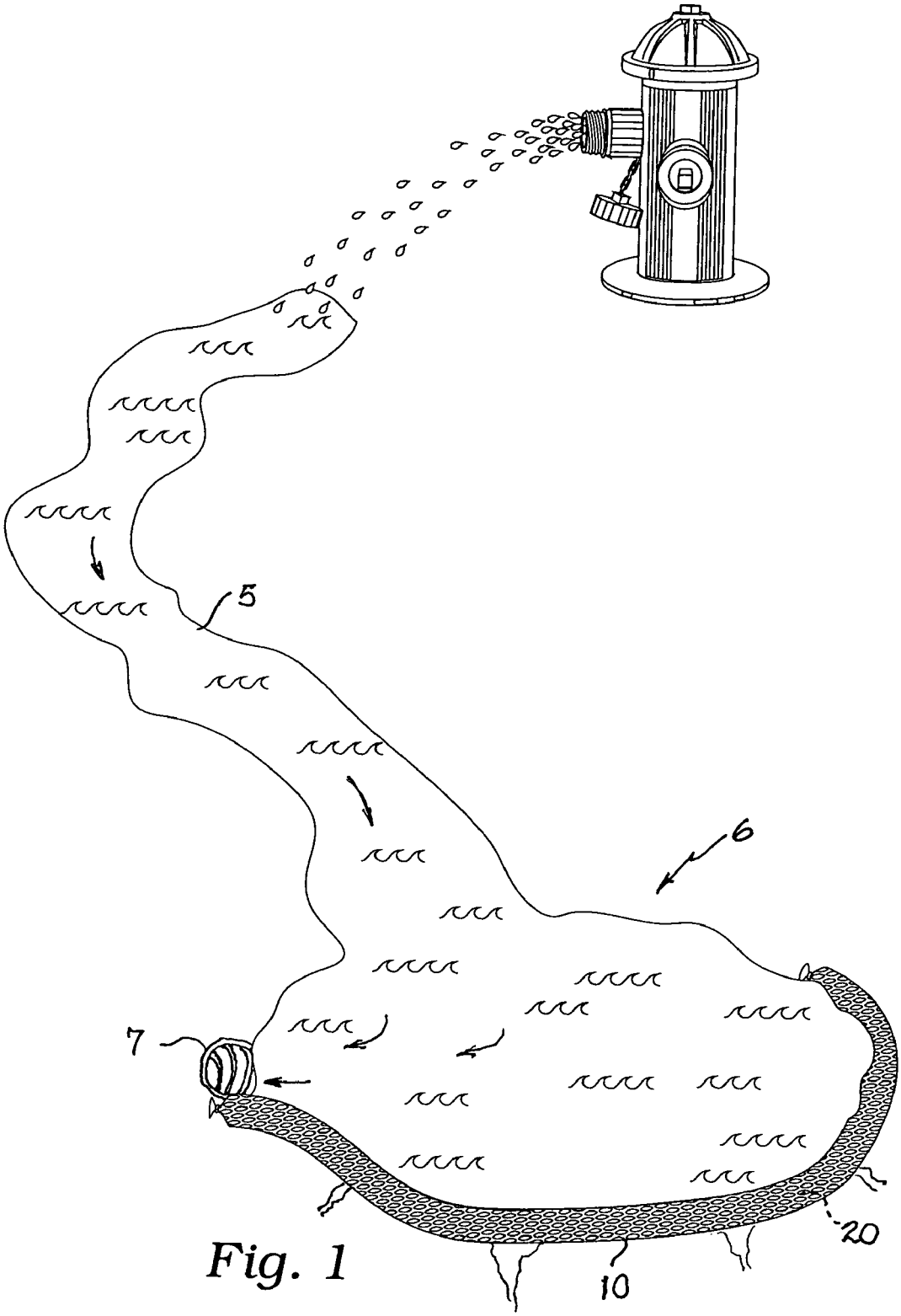
FIG. 1 is a perspective view of the preferred embodiment of the invention showing a typical use thereof.

In use, as shown in FIG. 1, the apparatus may be placed so as to actively pool a water flow 5, allowing only a small amount of such flow 5 to pass through the apparatus and diverting the main body of the flow 5 in a selected alternate direction. In this application, the apparatus is used to change the natural flow path of a water runoff 5. In FIG. 1 we see this application wherein only small amounts of water are able to penetrate the apparatus laid in the path of a water flow 5 while diverting the water to the left in FIG. 1, into culvert drain 7.

In another embodiment, the stocking 10 and fill material 20 are capable of filtering water flow 5 through both the stocking 10 and fill material 20. In this case solid materials being carried along in the water flow 5 may be captured within the apparatus while the bulk of the water flow 5 passes through. Materials may be captured in the apparatus by mechanical entrainment, mechanical absorption, chemical adsorption or other mechanisms. When such a flow 5 is carrying off gold dust particles from a mining operation, or when the flow 5 contains hazardous materials in particle form or dissolved within the flow, it is clear that the apparatus may be placed so as to provide significant benefit. In general use, the apparatus is used to prevent water flows from eroding or otherwise damaging or removing the surface of soils over which it passes. In this case, the apparatus has an almost unlimited number and types of uses, as will be further described below.

Figure 2:
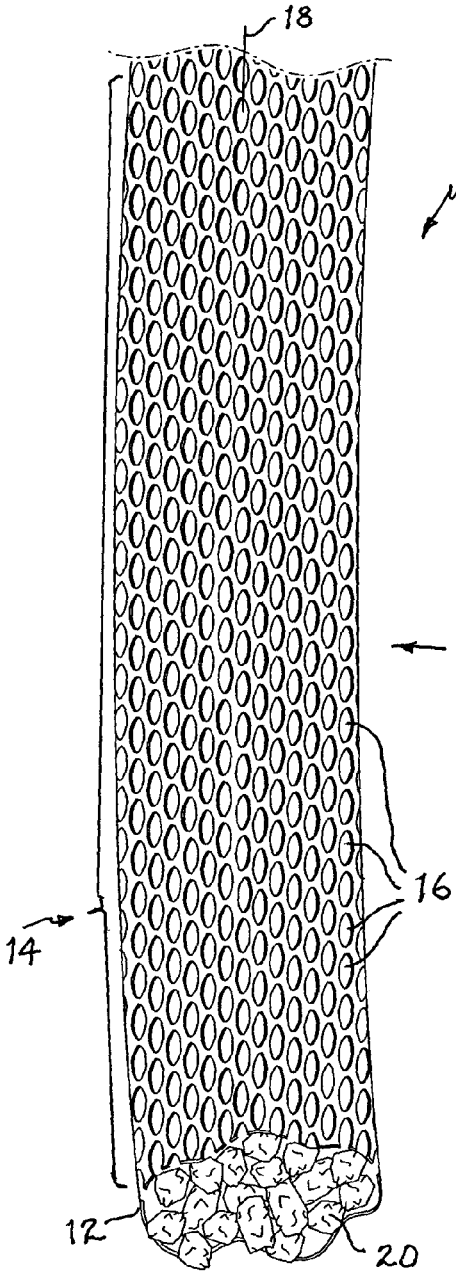
FIG. 2 is a side view thereof showing a stocking of the invention in a non-stretched state.

As shown in FIG. 2, the stocking 10 has a cylindrical sidewall 12 defining a sidewall surface area 14. The sidewall 12 provides plural through apertures 16 of a shape and placement in the sidewall 12 as to cover a majority of the surface area 14 and to enable the sidewall to expand radially in preference to axial extension. The stocking 10 is preferably made of a plastic or fabric sheet material of a flexible type but which is mechanically stable, i.e., not elastic so that it cannot be stretched beyond its normal size without rupture. Such materials include polypropylene, polyethylene and polyester sheet stocks.

Figure 3:
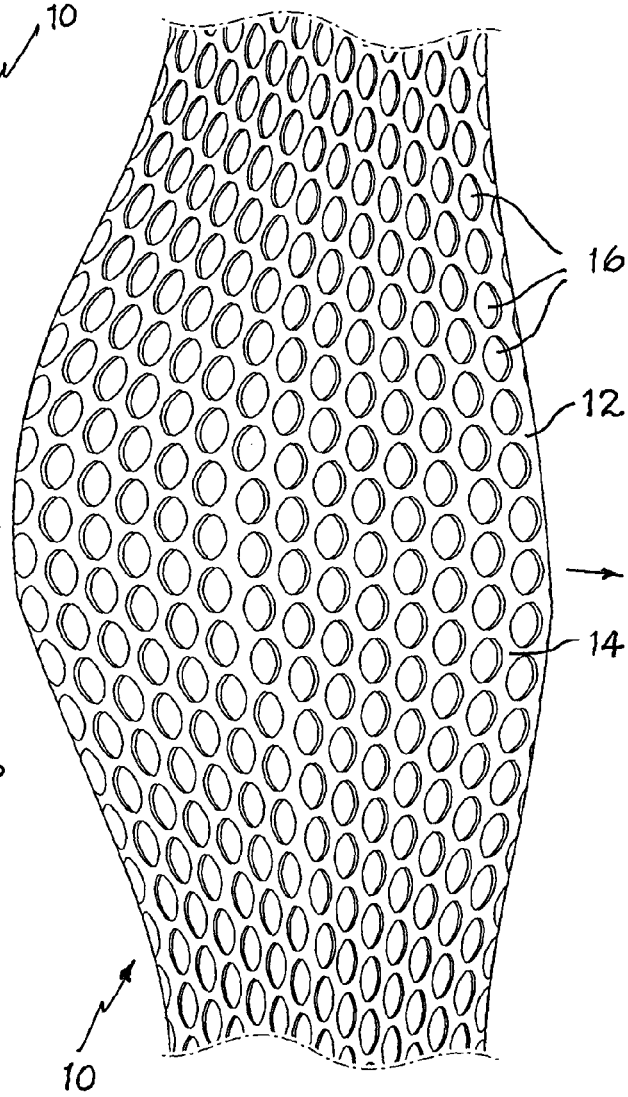
FIG. 3 is a side view thereof showing the stocking in a state of unilateral stretch.

The apertures 16 are preferably oval in shape, where each of the apertures has a long axis 18 that is, more or less, axially aligned with the longitudinal axis of the stocking 10. As shown in FIGS. 2 and 3, the apertures 16 are preferably arranged in axially aligned rows, the rows preferably being misaligned circumferentially, that is, as shown in FIG. 2, the rows are staggered. When internal pressure is applied to the sidewall 12, the apertures are more easily able to widen rather than lengthen, because of the oval shape. FIG. 3 clearly shows the nature of the change in the shape of the apertures when the stocking sidewall 12 expands. It should be clear that the material of the sidewall 12 does not stretch, but rather the apertures 16 change shape allowing the sidewall 12 to expand radially in preference to longitudinally. This characteristic of the sidewall 12 has some very interesting and important benefits including the fact that radial expansion permits the apparatus to swell so as to be able to contain a larger (deeper) pool of runoff water, while not changing in length appreciably so that the placement of the apparatus remains essentially stable. This is important in that placement of the apparatus in just the right location may be critical to its diverting or fluid capturing capability.

The fill material 20 is held within the stocking sidewall 12 as is best seen in FIG. 2 and is preferably made up of a fractured material such as black walnut shells which have been found to have a highly efficient filtering capability. Such fractured materials have irregular shapes and sizes and tend to have a large surface area. In the category of fractured materials we also include natural materials such as gravel, sand, diatomaceous earth, and many other materials which are in fact fractured, or of a fractured type structure formed by natural forces or a combination of natural formations and mining operations. Alternately, the fill material 20 may advantageously be a highly absorbent material such as certain seeds, sponges and other natural materials or manufactured chemical materials such as commercial desiccants and related materials. The first group of materials, having large surface areas and irregular shapes are good filtering media and thus enable the invention to be placed for the purpose of capturing particulates and dissolved chemicals. The capture of dissolved chemicals may require the use of a combination filter type media and a chemical capture resin. Such resins are common in the chemical industry for reducing chemical compounds in aqueous solutions as they move through resin beds or columns. The resinous capture material may be coated onto the filter material in order to provide both mechanical entrainment and chemical adsorption or compounding.

The second group of materials, those that expand during absorption of water or other runoff fluids, are interesting when used as the fill material 20 within the stocking 10. Such fill materials are preferably both highly absorbent, holding several times their own volume of water, and are also plastic materials, i.e., able to change shape and conformation readily. Sponges fall into this category as well as a very large number of natural and synthetic materials in soft solid, particulate and granulate consistencies. When used in the present invention, such materials capture rather than filter the water runoff 5. This is beneficial when hazardous materials are carried in such runoffs. When such materials expand, they tend to expand radially within the stocking 10 since interior exertions against the stocking sidewall 12 tend to force the sidewall to expand radially rather then longitudinally. When the stocking sidewall expands, the apparatus becomes a larger object in the path of the runoff and therefore has the ability to provide for establishment of a deeper pool of runoff water. Such a pool 6 is shown in FIG. 1. The benefit of this change in diametrical shape of the present apparatus is that the apparatus has a smaller size prior to contact with runoff 5 and this is advantageous as the apparatus is less likely to interfere with normal use of the land surface and be less obvious visually. However, when in the expanded condition, the apparatus is more effective that would be expected in pooling runoffs and in diverting runoffs due to its expanded size.

The present invention may be custom filled to provide any one of a combination of the above defined capabilities. For instance one may want to retard runoff velocity so as to prevent aggressive erosion of a soil surface by the runoff. At the same time one may want to capture and reclaim soils being carried away, extract chemicals within the runoff, kill bacteria, filter only particulate in the runoff that is of a certain size or greater and allow small particulate to flow through and possibly other objectives such as diverting the runoff to flow preferentially in a selected direction. By selection of the type of fill material 20, its size and shape, chemical coatings, such as iodine to kill bacteria, and hygroscopic character, it is possible to build an apparatus that is highly efficient in reaching any selected set of goals with respect to surface runoff events.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An erosion control apparatus comprising an elongate stocking having a flexible cylindrical sidewall defining a sidewall surface area, the sidewall having plural apertures of a shape and placement in the sidewall as to cover a majority of the surface area and to enable the sidewall to expand radially in preference to axial extension; wherein each of the apertures is oval in shape and oriented longitudinally with a long axis aligned axially with the stocking; and a fill material contained within the stocking, wherein the apertures are misaligned circumferentially.

2. The apparatus of claim 1 wherein the fill material is a fractured material.

3. The apparatus of claim 2 wherein the fractured material is walnut shells.

4. The apparatus of claim 1 wherein the fill material is highly absorbent.

5. The apparatus of claim 4 wherein the fill material is plastic and expands upon absorption of a liquid.

6. The apparatus of claim 1 wherein the fill material is coated with a chemical capable of chemical reaction with at least one component in a fluid passing through the fill material.

7. The apparatus of claim 1 wherein the apertures are oval shaped, each of the apertures having a long axis aligned axially with the stocking.

8. The apparatus of claim 7 wherein to apertures are arranged in axially aligned rows.

9. An erosion control method comprising the steps of: placing an elongate stocking filled with a fill material on a surface in the path of a fluid runoff; forming plural, axially oriented, oval shaped apertures in a flexible cylindrical sidewall of the stocking; such that the stocking expands radially in preference to axial extension and further comprising the step of misaligning the apertures circumferentially.

10. The method of claim 9 further comprising the step of fracturing the fill material.

11. The method of claim 9 further comprising the step of selecting a fill material that is highly absorbent.

12. The method of claim 9 further comprising to step of selecting a fill material that is plastic and expands upon absorption of a liquid.

13. The method of claim 9 further comprising the step of coating the fill material with a chemical capable of chemical reaction with at least one component in a fluid passing through the fill material.

14. The method of claim 9 further comprising the step of shaping the apertures as ovals and aligning a long axis of the apertures axially with the stocking.

15. The method of claim 9 further comprising the step of aligning the apertures in axially aligned rows.

* * * * *